US005659873A

United States Patent [19]

Seyrkammer

[11] Patent Number: 5,659,873

[45] Date of Patent: Aug. 19, 1997

[54] METHOD OF PRODUCING A CAM FOR A JOINTED CAMSHAFT

[75] Inventor: Josef Seyrkammer, Rüstorf, Austria

[73] Assignee: Miba Sintermetall Aktiengesellschaft, Laakirchen, Austria

[21] Appl. No.: 597,291

[22] Filed: Feb. 6, 1996

[30] Foreign Application Priority Data

Feb. 16, 1995 [AT] Austria ..... 284/95

[51] Int. Cl.[6] ..... B22F 3/12; B22F 3/24; B22F 5/00

[52] U.S. Cl. ..... 419/29; 419/38

[58] Field of Search ..... 419/29, 38

[56] References Cited

U.S. PATENT DOCUMENTS

| | | | |
|---|---|---|---|
| 4,616,389 | 10/1986 | Slee | 29/156.4 R |
| 4,927,688 | 5/1990 | Hass et al. | 428/34.6 |
| 5,082,433 | 1/1992 | Leithner | 419/11 |
| 5,529,602 | 6/1996 | Ishii et al. | 75/231 |

FOREIGN PATENT DOCUMENTS

| | | |
|---|---|---|
| 0303809 | 2/1989 | European Pat. Off. . |
| 38 34 401 | 4/1990 | Germany . |
| 42 01 695 | 8/1992 | Germany . |
| 43 07 562 | 9/1994 | Germany . |

*Primary Examiner*—Charles T. Jordan
*Assistant Examiner*—Daniel Jenkins
*Attorney, Agent, or Firm*—Collard & Roe, P.C.

[57] ABSTRACT

There is described a method of producing a cam for a jointed camshaft by sintering a compact made from a sintering powder, which is calibrated after sintering and then subjected to quenching and tempering. To avoid extensive rework, it is suggested that the compact be pressed, sintered and calibrated corresponding to a desired contour (4), which differs from the desired contour (1) of the cam contrary to the distortion (3) produced during quenching and tempering, and that the calibrated compact is then given the desired contour (1) of the cam due to the distortion (3) produced during quenching and tempering.

1 Claim, 2 Drawing Sheets

METHOD OF PRODUCING A CAM FOR A JOINTED CAMSHAFT

BACKGROUND OF THE INVENTION

This invention relates to a method of producing a cam for a jointed camshaft by sintering a compact made from a sintering powder, which compact is calibrated after the sintering process and is then quenched and tempered.

In order to be able to easily produce camshafts from a material corresponding to the respective loads acting thereon, cams are known to be produced by powder-metallurgical methods, and after a heat treatment, for instance by hardening and tempering, by quenching from the sintering heat or by nitriding, nitrocarburizing or plasma-nitriding, to be connected with a steel shaft by usual joining methods. In order to satisfy increased precision requirements, the sintered cams joined with the steel shaft must, however, be subjected to extensive rework by means of grinding, to ensure that not only the outer cam contour, but also its position with respect to the steel shaft lie within the predetermined close tolerances. Despite a substantial consideration of the shrinking behaviour of the cam compact during the sintering process and an extensive calibration of the sintered compact, it was not possible in the case of increased demands as to the dimensional accuracy to maintain the close tolerances to be required in this connection under the conditions of a series production of the cams without regrinding the outer contour of the cam.

It is therefore the object of the invention to improve a method of producing sintered cams for jointed camshafts of the above-described kind such that reworking the cams by means of grinding can be omitted even under the conditions of a series production.

This object is solved by the invention in that the compact is pressed, sintered and calibrated corresponding to a desired contour, which differs from the desired contour of the cam contrary to the distortion produced during quenching and tempering, and that then the calibrated compact is given the desired contour of the cam as a result of the distortion produced during quenching and tempering.

The invention is based on the knowledge that due to an uneven mass distribution over the periphery of the cam the heat treatment during the quenching and tempering of the calibrated cams leads to a distortion which is not uniform over the periphery of the cam and is disadvantageous for its dimensional accuracy, which distortion can be compensated by a corresponding contour of the compact made from the sintering powder. Prior to quenching and tempering, the desired contour of the sintered and calibrated compact must therefore differ from the desired contour of the cam contrary to the distortion caused by the quenching and tempering process, so that the deformation produced during quenching and tempering involves an adaptation of the contour of the compact to the desired contour of the cam. Since the cams are in addition clamped for boring the throughhole for the shaft at the shell, the more precise actual contour of the heat-treated cam leads to improved conditions for properly clamping the cams and thus a more precise alignment of the throughhole with respect to the outer contour of the cam, which altogether leads to the fact that even under the conditions of a series production cams having a high dimensional accuracy can be produced without having to subject the cams connected with the shaft to an extensive rework.

The inventive method of producing a cam will now be explained in detail with reference to the drawing, wherein:

PREFERRED EMBODIMENT OF THE INVENTION

Figure 1:
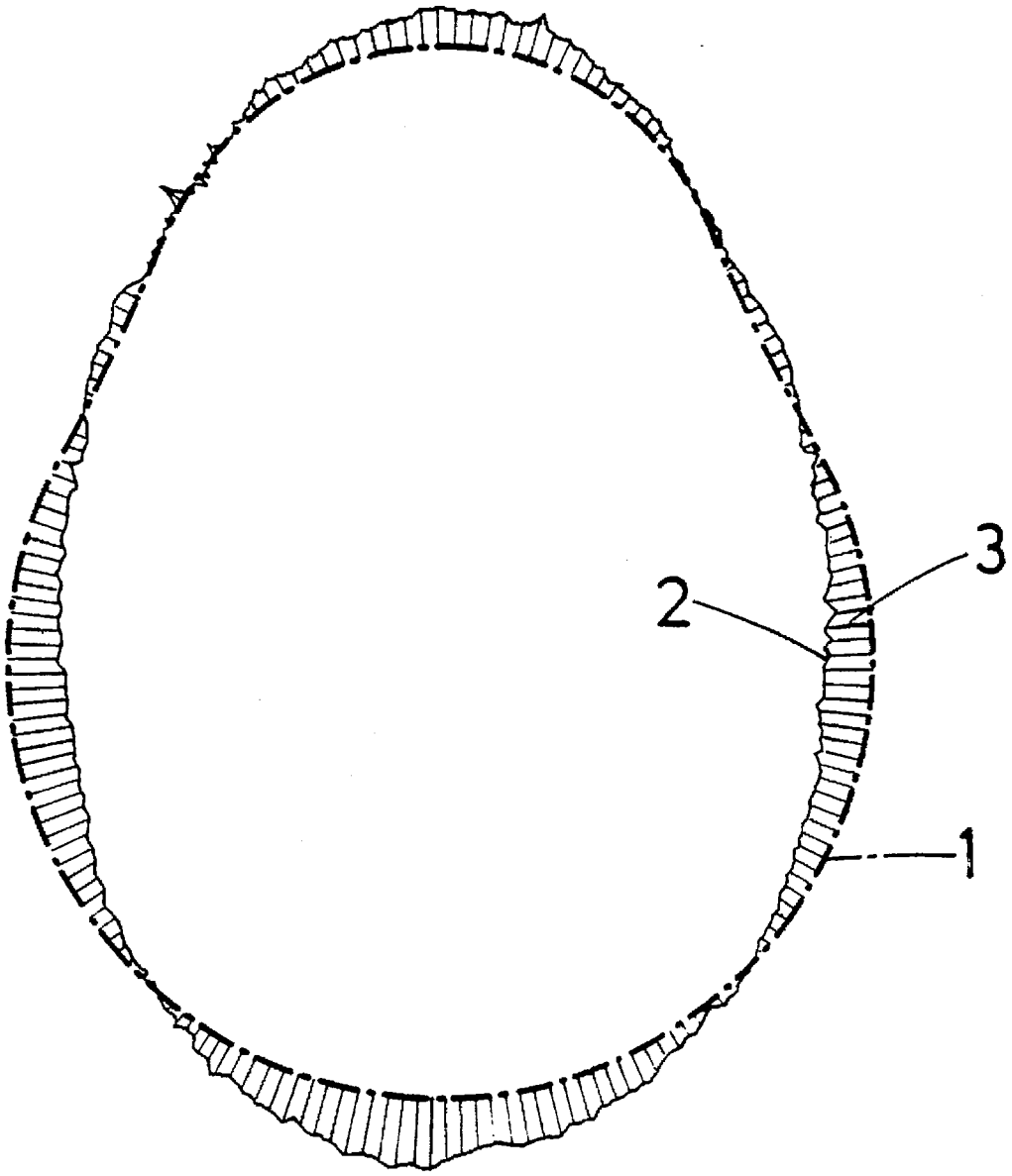
FIG. 1 shows a typical actual contour of a sintered cam made by conventional methods as compared to the desired contour of the cam.

For making a cam from a sintered steel having a high carbon content iron powder is used as a starting material, which contains for instance 0.2 to 2.0 wt. % molybdenum, 0.5 to 2.0 wt. % chromium, up to 2.0 wt. % copper and 0.6 to 1.2 wt. % carbon as alloying components, which can be present in the elementary form and except for carbon also as prealloy or diffusion alloy. This iron powder is pressed to form a compact by means of a pressing tool, the density of which compact should be as uniform as possible and larger than 6.9 g/cm$^3$. After presintering, the compact is subjected to a further pressing operation, which leads to an additional compaction to 7.4 to 7.6 g/cm$^3$, before the compact is finally sintered at a temperature of 1200° to 1300° C. Subsequent to this high sintering process the compact is calibrated to improve its dimensional accuracy, in that it is pressed through a die. For quenching and tempering the calibrated compact the same is then subjected to a heat treatment, in order to achieve the required hardness and strength as well as wear resistance. For this purpose the compact can be hardened by oil quenching from an austenitizing temperature of 850° to 900° C. to an oil temperature of more than 120° C. or by quenching from the sintering heat by blowing in nitrogen. Another possibility for quenching and tempering consists in nitriding, nitrocarburizing or plasma-nitriding, where due to the comparatively low treatment temperature of the nitriding process there is comparatively less distortion. Nevertheless there is quite a considerable influence on the outer contour of the cam, which affects the dimensional accuracy, as this is shown in FIG. 1, where the desired contour of the cam indicated in dash-dotted lines is designated with 1. In the case of the conventional cam production from sintered steel, the desired contour of the calibrated sintered compact before quenching and tempering corresponds to the desired contour 1 of the cam, which desired contour then leads to an actual contour 2 resulting from a distortion 3, which was considerably exaggerated in the drawing for a better illustration and actually has a size in the order of for instance 0.01 to 0.02 mm, which can, however, already lead to inadmissible deformations.

Figure 2:
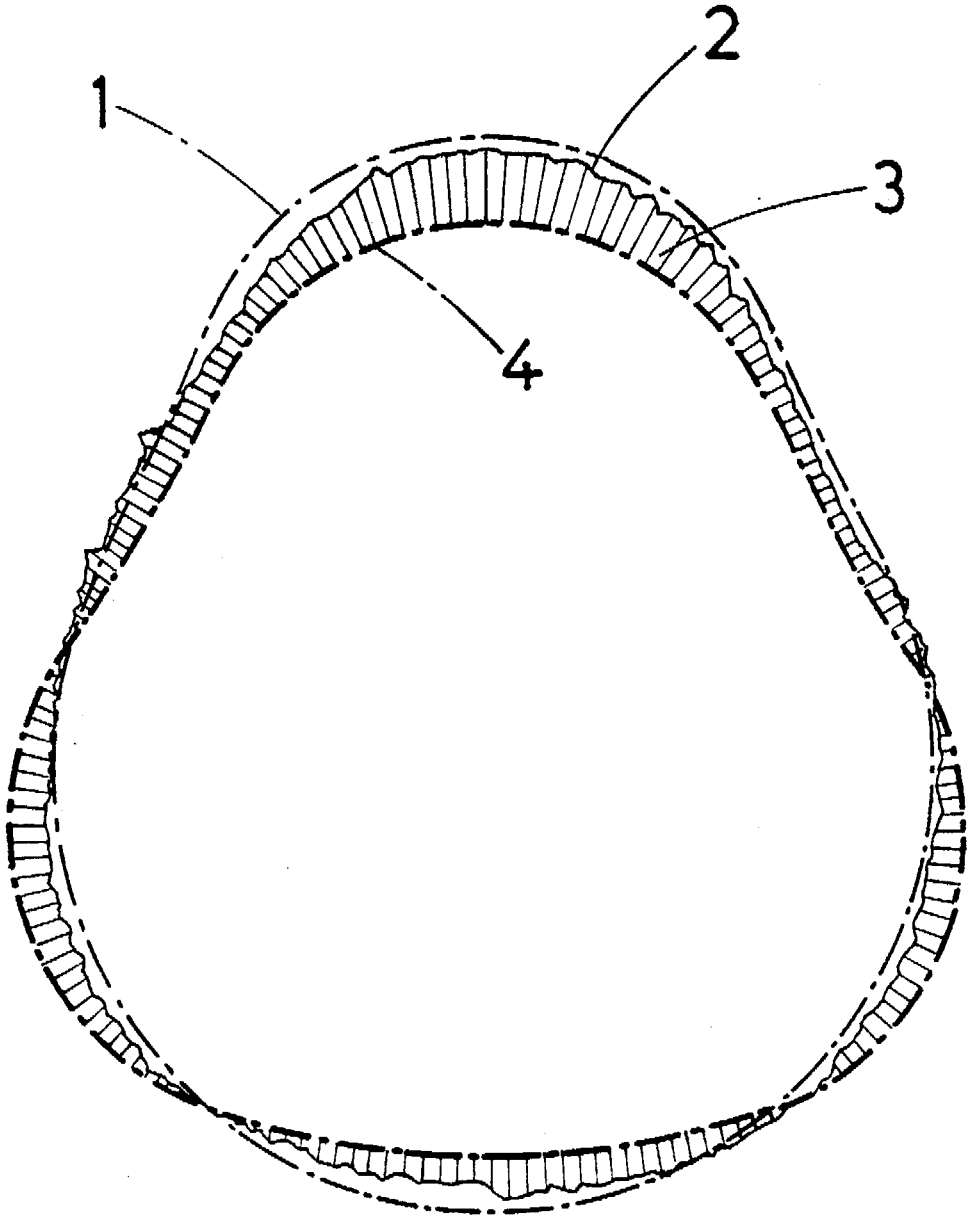
FIG. 2 shows a representation corresponding to FIG. 1 of the typical actual contour of a cam made in accordance with the invention as compared to the desired contour of the cam.

In order to avoid such inadmissible deformations, the pressing tool and the calibrating tool for the compact are not designed such in accordance with the invention that the calibrated compact in accordance with the prior art possibly corresponds to the desired contour 1 of the cam, but to a desired contour 4 which differs from the desired contour of the cam contrary to the expected distortion during quenching and tempering, as this is shown in FIG. 2. The amount of distortion over the periphery of the cams, which was determined for instance in preliminary tests for a certain quenching and tempering process, is taken into consideration when designing the forming tools for the compact, so that for instance the die for calibrating the compact before quenching and tempering has a drawing cross-section corresponding to the desired contour 4 for the compact that has not yet been quenched and tempered. This desired contour of the untreated compact leads to a distortion 3 during the heat treatment of quenching and tempering, which distortion 3 provides for a good approximation of the actual contour 2 of the quenched-and tempered cam to its desired contour 1. The comparison of the deviations of a typical actual contour 2 of a cam made in accordance with FIG. 1 and a cam made in accordance with the invention as shown in FIG. 2 from the desired contour of the cam clearly illustrates the superiority of the production method in accordance with the invention over the conventional production methods.

I claim:

1. A method of producing a cam for a jointed camshaft by sintering a compact made from a sintering powder, which is calibrated after sintering and then subjected to quenching and tempering, characterized in that the compact is pressed, sintered and calibrated corresponding to a desired contour, which differs from the desired contour of the cam contrary to the distortion produced during quenching and tempering, and that then the calibrated compact is given the desired contour of the cam due to the distortion produced during quenching and tempering.

* * * * *